US010417838B2

(12) United States Patent
Basir et al.

(10) Patent No.: US 10,417,838 B2
(45) Date of Patent: Sep. 17, 2019

(54) DRIVING EVENT CLASSIFICATION SYSTEM

(71) Applicant: Intelligent Mechatronic Systems Inc., Waterloo (CA)

(72) Inventors: Otman A Basir, Waterloo (CA); William Ben Miners, Guelph (CA); Seyed Hamidreza Jamali, Waterloo (CA)

(73) Assignee: APPY RISK TECHNOLOGIES LIMITED, Cheshire (GB)

( * ) Notice: Subject to any disclaimer, the term of this patent is extended or adjusted under 35 U.S.C. 154(b) by 778 days.

(21) Appl. No.: 14/055,407

(22) Filed: Oct. 16, 2013

(65) Prior Publication Data

US 2014/0148972 A1 May 29, 2014

Related U.S. Application Data

(60) Provisional application No. 61/714,287, filed on Oct. 16, 2012.

(51) Int. Cl.
*G07C 5/08* (2006.01)
*G07C 5/00* (2006.01)

(52) U.S. Cl.
CPC ..... *G07C 5/008* (2013.01); *G07C 5/0841* (2013.01)

(58) Field of Classification Search
CPC ..... G06F 19/00; G09B 19/16
See application file for complete search history.

(56) References Cited

U.S. PATENT DOCUMENTS

2003/0009270 A1* 1/2003 Breed ..... B60C 11/24 701/32.4
2010/0019880 A1* 1/2010 Huang ..... G07C 5/085 340/5.1
2010/0209892 A1* 8/2010 Lin ..... G09B 9/05 434/71

FOREIGN PATENT DOCUMENTS

EP 1811481 7/2007
EP 2375385 10/2011

OTHER PUBLICATIONS

International Search Report for PCT Application No. PCT/US2013/065257.
International Preliminary Report on Patentability for PCT Application No. PCT/US2013/065257, dated Apr. 30, 2015.

* cited by examiner

*Primary Examiner* — Thomas G Black
*Assistant Examiner* — Ana D Thomas
(74) *Attorney, Agent, or Firm* — Carlson, Gaskey & Olds, P.C.

(57) ABSTRACT

This vehicle monitoring system provides a plurality of sensors in the vehicle recording performance of the vehicle. A processor (remote or on-board) receives data from the sensors. The processor classifies the data from the at least one sensor as an event in one of a plurality of classifications. The processor associates at least one parameter with the classification.

12 Claims, 5 Drawing Sheets

DRIVING EVENT CLASSIFICATION SYSTEM

BACKGROUND

Some telematics systems monitor vehicle and driver events and conditions. A device installed in the vehicle may include one or more on-board sensors, such as accelerometers (such as a three-axis accelerometer), a gps receiver, etc. The device may receive further information from the vehicle's on-board diagnostics port (e.g. OBD-II), including vehicle speed. This information, or summaries thereof, may be sent to a server (or multiple servers) for collection and analysis.

One way this information can be used is for determining a rate of car insurance that should be charged for the driver and/or vehicle. Some of this information is made available to the driver and/or vehicle owner, such as via a web browser (or via the internet through a dedicated application).

SUMMARY

A significant and rapidly increasing volume of data is available from sensors both within and surrounding modern vehicles. This data, although massive in volume, is beneficial only after interpretation or transformation into directly meaningful information for specific applications. Interpreting this data to derive important events, key driving indicators, or to recognize specific vehicle behaviors results in concise and information rich vehicle events that can be consumed by applications including usage-based-insurance, preventative maintenance, anomaly/exception alerts, and driving behavior improvements through direct or indirect feedback.

DETAILED DESCRIPTION

Figure 1:
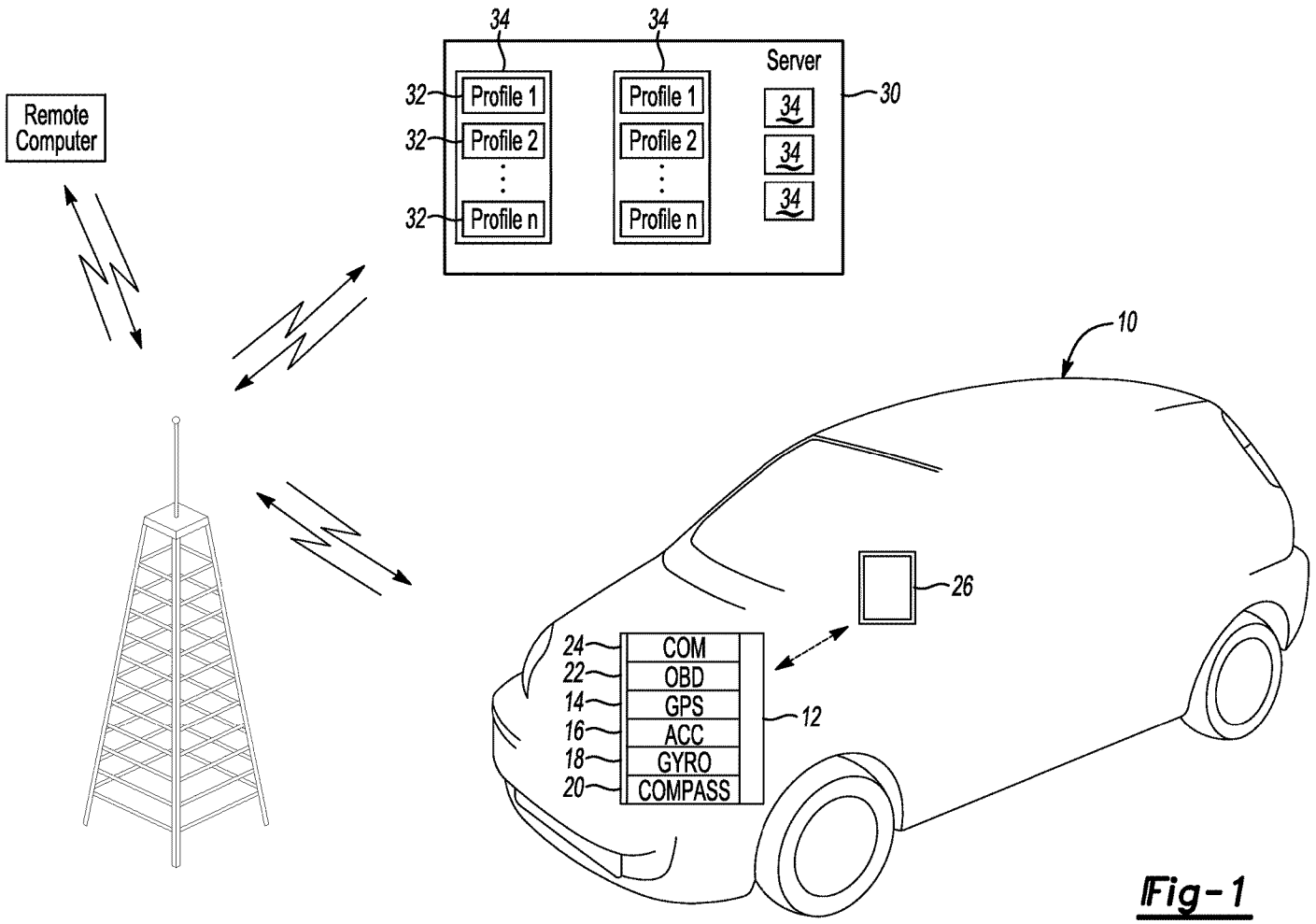
FIG. 1 is a schematic of a monitoring system according to one embodiment of the present invention.

Referring to FIG. 1, a motor vehicle 10 includes a plurality of data gathering devices that communicate information to an appliance 12 installed within the vehicle 10. The example data gathering devices include a global positioning satellite (GPS) receiver 14, a three-axis accelerometer 16, a gyroscope 18 and an electronic compass 20, which could be housed within the appliance 12 (along with a processor and suitable electronic storage, etc. and suitably programmed to perform the functions described herein). As appreciated, other data monitoring systems could be utilized within the contemplation of this invention. Data may also be collected from an onboard diagnostic port (OBD) 22 that provides data indicative of vehicle engine operating parameters such as vehicle speed, engine speed, temperature, fuel consumption (or electricity consumption), engine idle time, car diagnostics (from OBD) and other information that is related to mechanical operation of the vehicle. Moreover, any other data that is available to the vehicle could also be communicated to the appliance 12 for gathering and compilation of the operation summaries of interest in categorizing the overall operation of the vehicle. Not all of the sensors mentioned here are necessary, however, as they are only listed as examples.

The appliance 12 may also include a communication module 24 (such as cell phone, satellite, wi-fi, etc.) that provides a connection to a wide-area network (such as the internet). Alternatively, the communication module 24 may connect to a wide-area network (such as the internet) via a user's cell phone 26 or other device providing communication.

The in vehicle appliance 12 gathers data from the various sensors mounted within the vehicle 10 and stores that data. The in vehicle appliance 12 transmits this data (or summaries or analyses thereof) as a transmission signal through a wireless network to a server 30 (also having at least one processor and suitable electronic storage and suitably programmed to perform the functions described herein). The server 30 utilizes the received data to categorize vehicle operating conditions in order to determine or track vehicle use. This data can be utilized for tracking and determining driver behavior, insurance premiums for the motor vehicle, tracking data utilized to determine proper operation of the vehicle and other information that may provide value such as alerting a maintenance depot or service center when a specific vehicle is in need of such maintenance. Driving events and driver behavior are recorded by the server 30, such as fuel and/or electricity consumption, speed, driver behavior (acceleration, speed, etc.), distance driven and/or time spent in certain insurance-risk coded geographic areas. For example, the on-board appliance 12 may record the amount of time or distance in high-risk areas or low-risk areas, or high-risk vs. low risk roads. The on-board appliance 12 may collect and transmit to the server 30 (among other things mentioned herein): Speed, Acceleration, Distance, Fuel consumption, Engine Idle time, Car diagnostics, Location of vehicle, Engine emissions, etc.

The server 30 includes a plurality of profiles 32, each associated with a vehicle 10 (or alternatively, with a user). Among other things, the profiles 32 each contain information about the vehicle 10 (or user) including some or all of the gathered data (or summaries thereof). Some or all of the data (or summaries thereof) may be accessible to the user via a computer 32 over a wide area network (such as the internet) via a policyholder portal, such as fuel efficiency, environmental issues, location, maintenance, etc. The user can also customize some aspects of the profile 32.

It should be noted that the server 30 may be numerous physical and/or virtual servers at multiple locations. The server 30 may collect data from appliances 12 from many different vehicles 10 associated with a many different insurance companies. Each insurance company (or other administrator) may configure parameters only for their own users. The server 30 permits the administrator of each insurance company to access only data for their policyholders. The server 30 permits each policyholder to access only his own profile and receive information based upon only his own profile.

The server 30 may not only reside in traditional physical or virtual servers, but may also coexist with the on-board appliance, or may reside within a mobile device. In scenarios where the server 30 is distributed, all or a subset of relevant information may be synchronized between trusted nodes for the purposes of aggregate statistics, trends, and geo-spatial references (proximity to key locations, groups of drivers with similar driving routes).

In the present system, important events are derived from vehicular behavior. Driving events using solely in-vehicle information can be associated with classifications including:

Right turn
Left turn
Roundabout
Lane change
Rolling stop
U-turn
Accelerating up an onramp
Decelerating down an offramp
Hard acceleration
Hard deceleration
Potential crash
Vehicle being towed
Road type (dirt road, pavement, concrete)

Although some of these driving events can be derived by cross-referencing basic in-vehicle information with external sources (i.e. road network information or outward-facing sensors), the unique approach applied to classify these events is in the exploitation of information across multiple high precision in-vehicle sources describing vehicle and driving dynamics. For example, if external sources are included, the road type can be quickly determined by cross-referencing the location of the vehicle against a map dataset that has road types encoded. Unfortunately, even road types can change faster than the underlying map can be updated. Use of in-vehicle sources to infer road types ensures accurate and up-to-date information is captured to describe driving behavior. The in-vehicle sensors typically employed are a 3-axis accelerometer paired with vehicle speed sensors. The time-series data describing high precision vehicle dynamics is then applied to classify specific driving events without requiring external inputs like map datasets. Use of commodity sensors (3-axis accelerometer) also ensures this approach can be applied to any moving vehicle, such as a trailer, construction vehicle, off-road vehicle, or passenger vehicle without requiring changes to the vehicle itself.

Lane change detection is derived using a combination of lateral acceleration and vehicle heading changes over a short time window.

Rolling stops are classified using patterns of repeated deceleration below 20, 10, or 5 km/h followed by acceleration—typically during a regular commute or familiar roads (repeatability).

On-ramp and off-ramps are classified using speed profiles combined with lateral and vertical acceleration variations as cues.

Parametric representation of classified driving events to explicitly associate relevant parameters to the event itself. Examples of these parameters include the "aggressiveness" of an aggressive lane change, the "hardness" of a hard cornering event, and the "smoothness" of a trip. Other parameters may include the start and stop times and locations of an event when location information is available.

Representing each classified event as not just an event within a class, but a class with specific parameters allows the overall number of classes to be kept to a manageable size while preserving additional flexibility to order or rank individual events within the same class based on predefined class-specific parameters. Preserving these parameters is valuable especially as events emerge from in-vehicle sources to be used in higher level decision support systems and driver-feedback systems. Although most parameters describe the level of severity of the event, parameters that describe the certainty and precision of the event capture process itself are also important.

To help illustrate this parametric representation a harsh braking class will be analyzed for a small set of events. Current applications of harsh braking define harsh braking as a single event and use the frequency of these events to measure behavior. By including not just the presence or absence of the event itself, but the severity of the braking event as a parameter, one can gain deeper insight into actual driving behavior.

Figure 2:
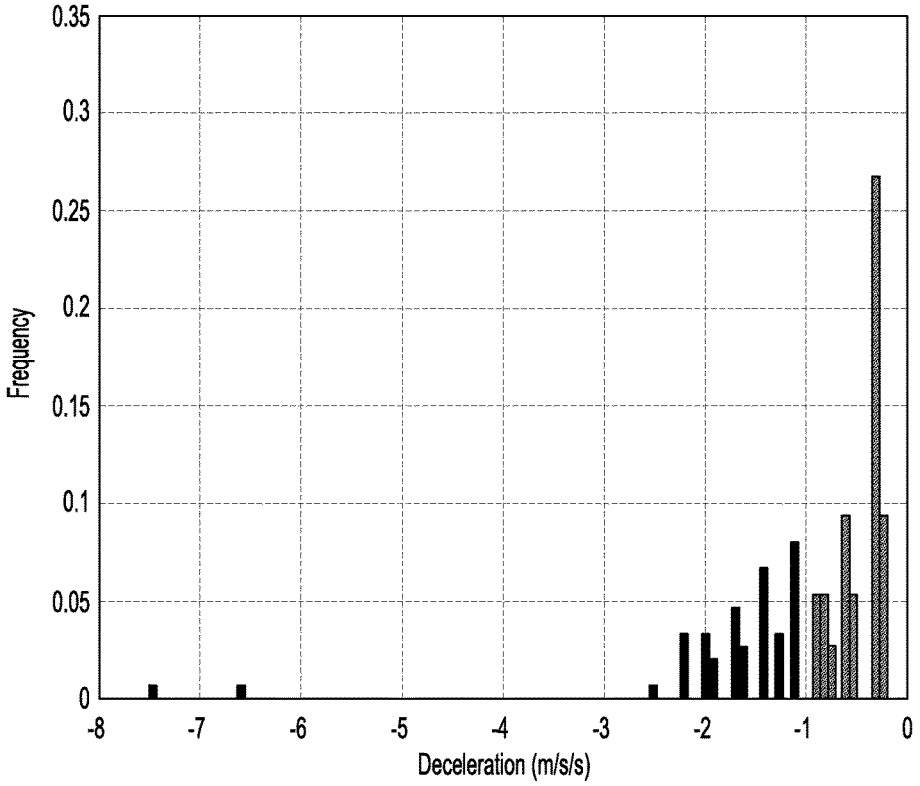
FIG. 2 shows a graph of a distribution of harsh braking events, showing the frequency of harsh braking events of various severities.

In FIG. 2, the frequency of not just harsh braking events, but harsh braking events with a parameter describing severity is illustrated. The shape of this distribution describes a particular driving style, i.e. the conservative very smooth driver represented with a distribution biased to the right. An aggressive driver would generate a distribution that has a long tail toward the left. These two types of driving may appear similar when only considering the frequency of the event, omitting the critical parameters describing each event.

Linking classification confidence to the event, in addition to a relevant time-window of the underlying data supporting the classification, and a measure of precision or certainty in the result.

Some driving events can often be difficult to classify with absolute certainty. In these scenarios, linking each driving event within its temporal context and measures of precision for each data source helps to characterize the event beyond just a "hard acceleration" or "hard cornering" event. For example, capturing a hard cornering event as not a single point in time, but a short time window with an angular acceleration profile, steering angle, yaw/pitch/roll information, and vehicle speed, each with associated measures of precision provides a richer characterization of the event itself. This approach places each event within an appropriate context—for a short window both before and after the event trigger itself.

Classification of vehicle events using multiple sensors to improve the overall accuracy of the classification, leveraging knowledge about the complementary or distinct characteristics of available sensors and overlapping regions of perception between sensors.

In scenarios where both vehicle speed information and accelerometer information is available, the longitudinal acceleration of the vehicle can be obtained from either source. This overlap in coverage across these two specific sensors helps to improve accuracy by using the vehicle speed values as absolute reference points and the accelerometer values to interpolate fine speed changes between successive absolute values from the vehicle. In cases where there is a misalignment between the two sensors, a broader window of time can be included to assess sensor performance and capture the quality of the information available about the vehicle speed.

Classification of vehicle events using a combination of internal and external data sources to capture not only observations from within the vehicle, but external perspectives. This information is used to incorporate environmental parameters (wet road conditions, ice, bright sunshine, . . . ), traffic conditions (driving in congestion, stop-and-go, or on an open road), and historical trends of both the vehicle and its environment.

Placing an event within the context of recent vehicle behavior is important, but pulling in information from external data sources can help to provide additional context about specific events. This additional context is critical to adapt and adjust event triggers to reflect practical scenarios. Event triggers may be much more sensitive in wet and icy conditions than in dry, and can be adjusted appropriately in this solution by incorporating external data sources. Examples of these sources include Weather from nearby ground weather stations, weather as measured by nearby vehicle probes (ambient air temperature, barometric pressure, humidity, and road surface conditions), Roadside and embedded road sensors for road surface conditions, traffic, and weather, Vehicle equipped proximity sensors Lighting conditions (i.e. overcast, or sun setting directly in the driver's eyes?)

Road network information describing road connectivity, school zones, etc., and

Transient incident, road blockage, or construction activities

Historical trends of vehicle movements and the environment in which it travels are used as proxies where real measurements are not available, and are also used to generate predictive models to anticipate external parameters. This approach is valuable to provide the most likely information in the absence of direct measurements about the vehicle and/or the environment in which it travels. A simple example can be described using traffic patterns: Given historical trends of traffic levels on a snowy day on a specific road on a Friday evening, one can predict similar characteristics on another day with similar weather, road, and day/time constraints. Knowing that the vehicle typically commutes between work and home Monday to Friday, predictive models are applied to anticipate relevant information about road conditions, traffic, and weather for the given route based on the assumption that the vehicle will continue to commute between work and home Monday to Friday.

Leveraging classification to dynamically optimize compression and data representation algorithms for wireless data transmission and storage by recognizing events and key patterns within the vehicle over time, prior to transmission. Applying knowledge about both individual classes and repetitive driving patterns enables the vehicle to succinctly transfer information describing vehicle behavior as a function of historical (repeated) patterns and event classifications. This approach supports a lossless compression approach, exploiting shared knowledge at both ends of the communication channel about historical driving events and vehicle trends. For example, knowing that the vehicle travels along the same route each morning from home to work, only the exceptions or deviations from a historically derived pattern need to be described and shared to reconstruct the entire journey.

In some deployments, only the key driving indicators or essential events are important for the success of the program. The use of classification within the vehicle itself enables use of an optimized application-specific compression approach. This approach leverages knowledge about driving behavior and known classes to intelligently eliminate redundancies in transmission, capturing only the most relevant events and (unlike generic compression approaches), avoiding the need to send less relevant "noise" in the data itself. A simple example of this approach is to transfer complete vehicle dynamics for a few seconds before and after each start, stop, cornering, and aggressive maneuver, and only summarize the remaining journey (i.e. total distance traveled, start/end time, start/end location)

Automatic anomaly and exception detection. The classification of driving events includes not only classification of known behaviors (left turn, right turn, U-turn, etc.), but also classification of normal driving behavior (driving down a residential road, highway, etc.). Anomalies and out-of-class exceptions are automatically captured and provided for further analysis or action. These exceptions are important to identify sensor failures, abnormal vehicle behavior, unbalanced or misaligned wheels, tampering, warped brake discs, and more. Sensor failures are identified using conflicts between the suspected sensor failure and redundant sources of information (i.e. acceleration derived from vehicle speed sensor vs. acceleration derived from an accelerometer). Unbalanced or misaligned wheels can be detected through either the subtle vibrations of the vehicle at specific speeds, or through the tendency of the vehicle to turn left or right without external input (i.e. in the absence of driver steering corrections). The continual correction or force applied to compensate for a vehicle shifting to one side or another is important input to detect misaligned wheels.

Leveraging learned experience and predefined knowledge about the specific vehicle's dynamics and behavior, the same classification approach proposed here can be used to identify issues with the vehicle itself. This includes using the same in-vehicle sensors and classification approach to proactively identify alignment issues and sensor failures. There are some synergies between this approach and driver classification, allowing both to be used in combination with one another to gain further insight into both driving and driver behavior. With sufficient driving data from more than one person using the same vehicle, the influence of the individual driver can be decoupled from the vehicle dynamics. Once the driver influence is separated from the vehicle dynamics, vehicle trends can be consistently analyzed even through multiple drivers in the same vehicle. Without addressing driver classification, information about vehicle dynamics is biased by each driver, reducing the accuracy of detecting issues with the vehicle itself.

Parameter adaptation to driving trends. In applications where the extreme events are of interest, the classification parameters are automatically adapted based on historical driving characteristics of each vehicle combined with trends across vehicles in the same peer-group (based on proximity, vehicle type, driving patterns, emissions, and other parameters). The automatic adaptation of parameters allows the extreme x % of vehicles and/or the extreme y % of events to be quickly identified even as driving conditions change. Dynamic parameter adaptation to driving trends helps minimize redundant communication and eliminate the need to capture, transmit, and store large datasets of more common events. As the extreme events of interest are refined for each peer-group, the specific parameters around these extreme events can be pushed to each vehicle to ensure only the events of interest are transmitted.

Driving parameters are used to classify the level of care used in driving the vehicle (abusive driving vs careful driving).

A classification method is employed to map use driving parameters to categorize the driver into one of driver categories: aggressive, diligent, high-risk, low-risk, distracted.

Generalizing the classifications from in-vehicle and external sources, each journey can be categorized into a relevant risk or focus level. This unique mapping from driving event parameters to relevant driver risk or focus level is valuable to passively determine level of risk using available information sources.

Based on location information, and historical driving data the usage of the vehicle can be categorized in to one of: work related, pleasure, etc.

Automatic separation of work related and personal journeys is made possible by combining expert rules and historical trends. A simple example is a vehicle that is driven to a specific building Monday to Friday at 9 am and returned at 5 pm, resulting in a reasonable assumption that the specific building is a work location and the journeys after 5 pm are personal or on the way home. Incorporating location information allows specific destination characteristics to be incorporated, including residential, commercial, or other attributes to be leveraged.

Figure 3:
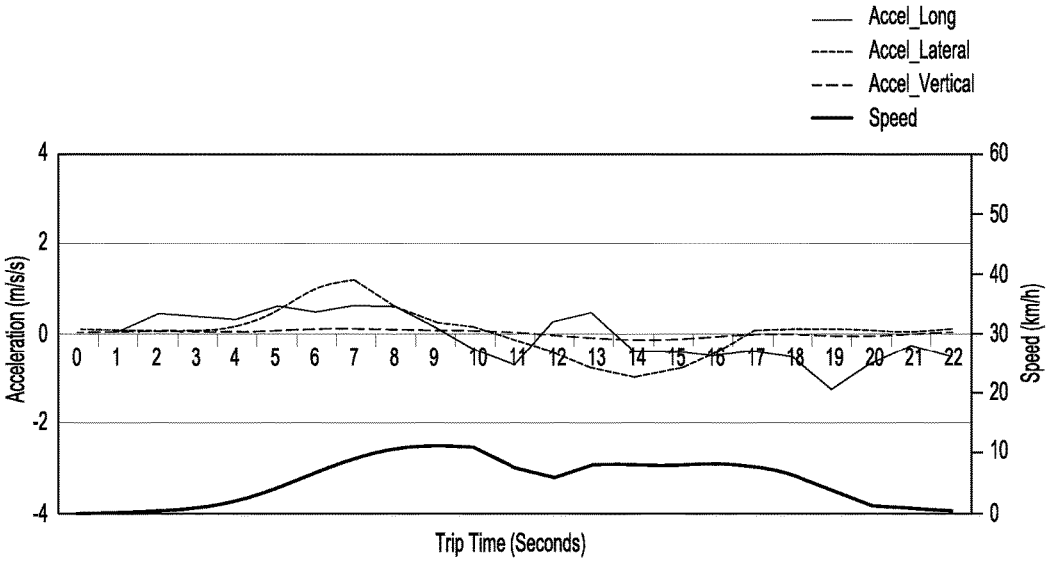
FIG. 3 illustrates the sensor signals for the vehicle driving through a parking lot.
Figure 4:
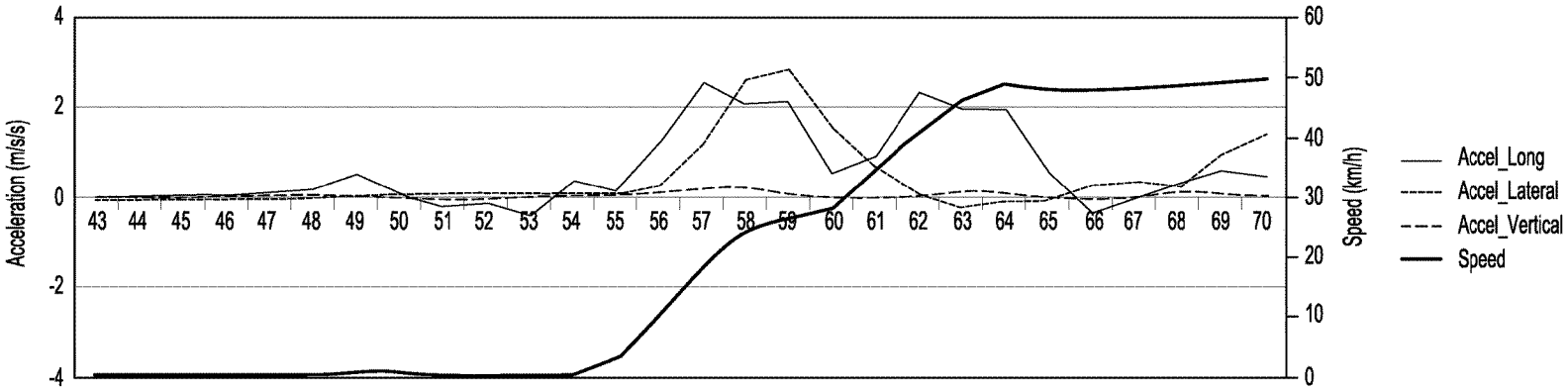
FIG. 4 shows the sensor signals for the vehicle accelerating and turning left out of a parking lot.
Figure 5:
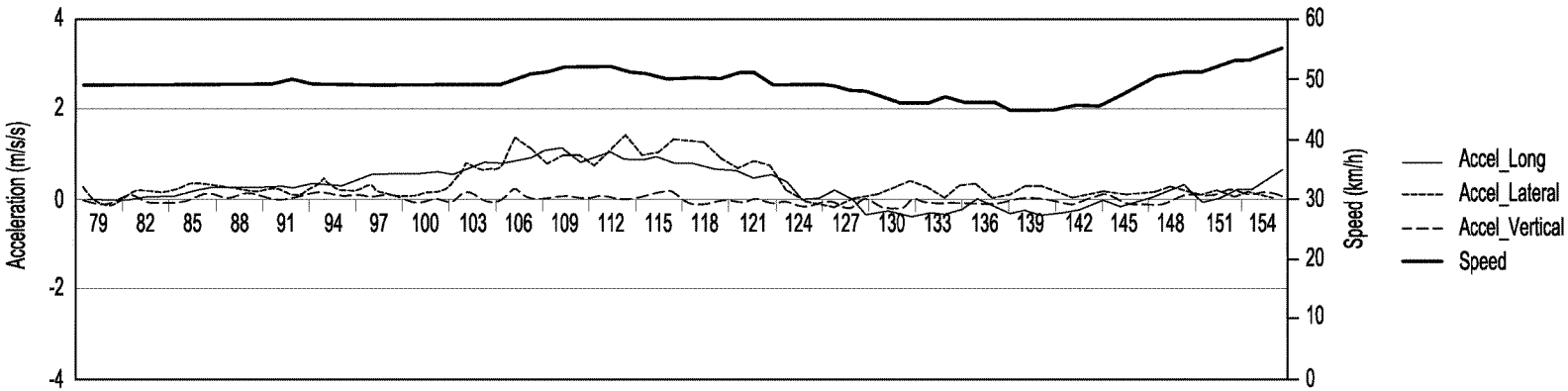
FIG. 5 shows the sensor signals for the vehicle driving up an incline while turning left around a bend in the road.
Figure 6:
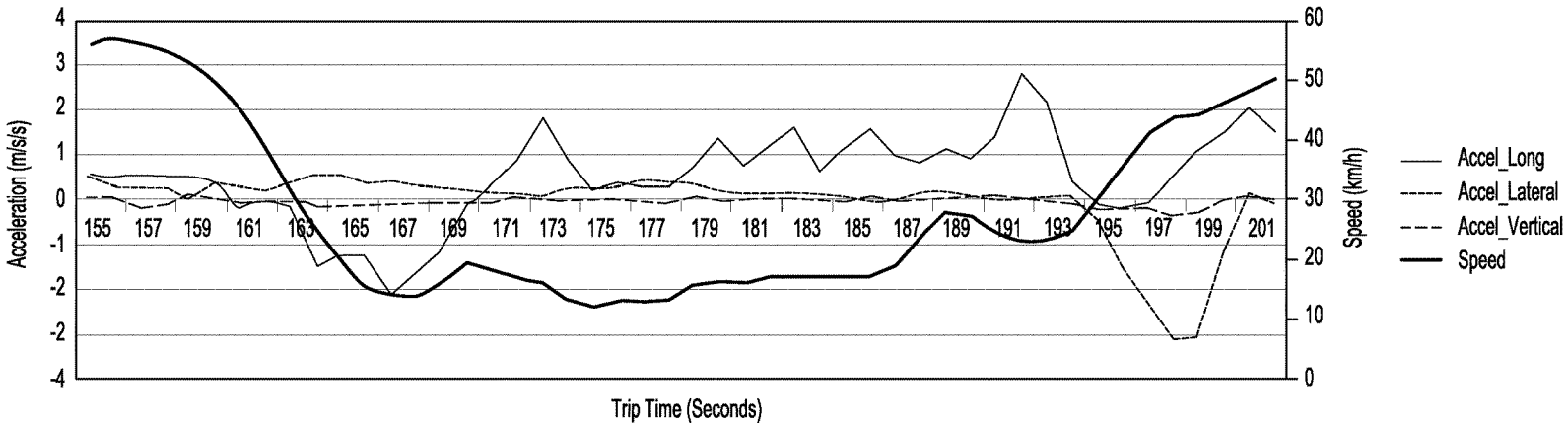
FIG. 6 shows the sensor signals for the vehicle slowing down (not stopping) and making a right turn.
Figure 7:
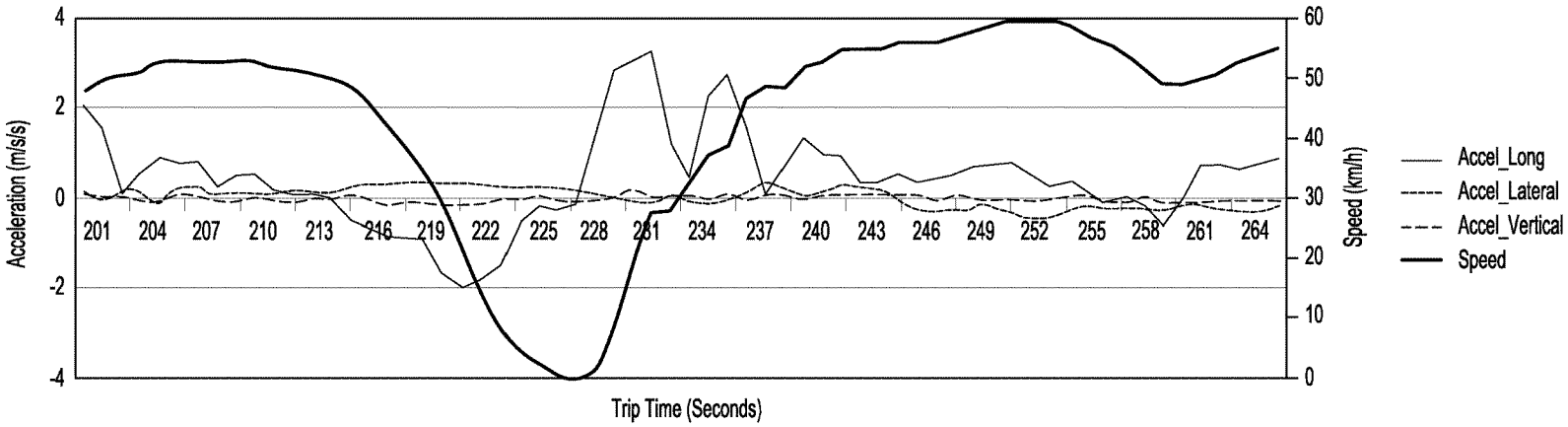
FIG. 7 shows the sensor signals for the vehicle stopping at an intersection and continuing forward.
Figure 8:
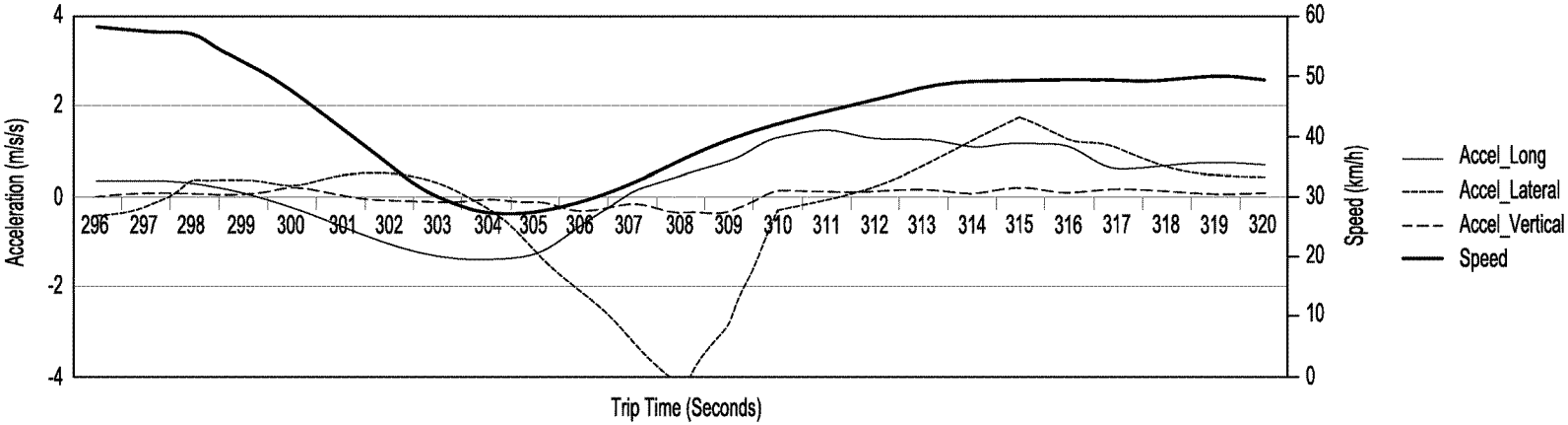
FIG. 8 shows the sensor signals for the vehicle making a right turn at 30-40 km/h.
Figure 9:
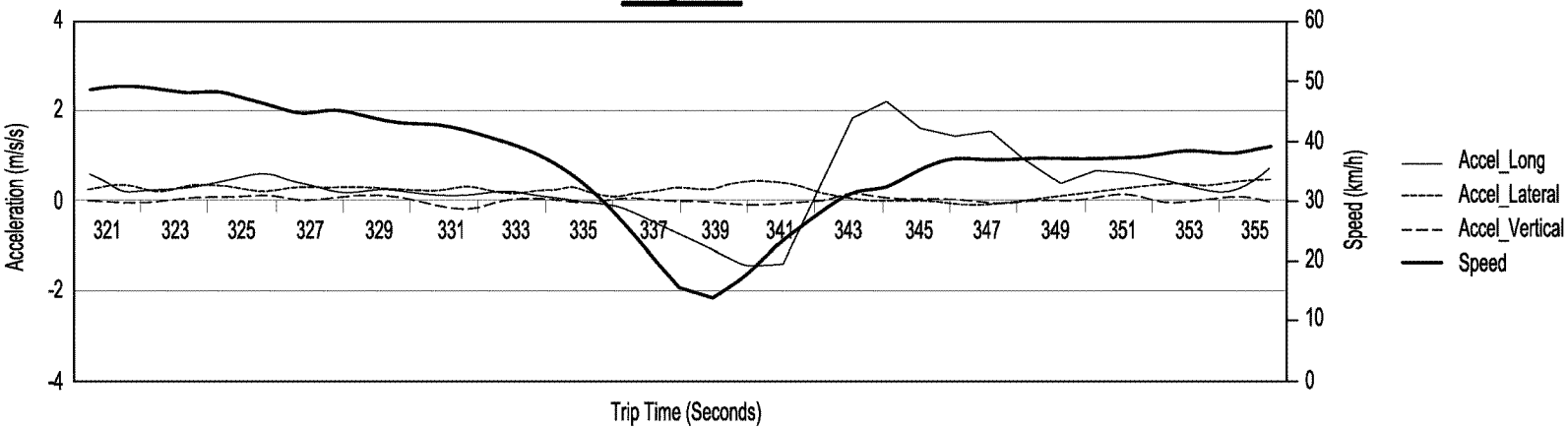
FIG. 9 shows the sensor signals for the vehicle making a rolling stop.

Event classification examples using only accelerometer and vehicle speed data are shown in FIGS. 3-9. FIGS. 3-9 show over time the vehicle speed s (e.g. from OBD and/or accelerometer 16), longitudinal acceleration $A_{long}$, lateral acceleration $A_{lat}$ and vertical acceleration $A_v$, from accelerometer 16 for several different events. FIG. 3 illustrates the sensor signals for the vehicle driving through a parking lot. FIG. 4 shows the sensor signals for the vehicle accelerating and turning left out of a parking lot. FIG. 5 shows the sensor signals for the vehicle driving up an incline while turning left around a bend in the road. FIG. 6 shows the sensor signals for the vehicle slowing down (not stopping) and making a right turn. FIG. 7 shows the sensor signals for the vehicle stopping at an intersection and continuing forward. FIG. 8 shows the sensor signals for the vehicle making a right turn at 30-40 km/h. FIG. 9 shows the sensor signals for the vehicle making a rolling stop.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A vehicle monitoring system comprising:

at least one sensor in the vehicle, the at least one sensor recording performance of the vehicle; and a processor receiving data from the at least one sensor, the processor classifying the data from the at least one sensor as an event in one of a plurality of classifications, the processor associating at least one parameter with the event within the one of the plurality of classifications, wherein the processor is programmed to adapt the plurality of classifications based upon data from a plurality of vehicles including the vehicle.

2. The vehicle monitoring system of claim 1 wherein the event is classified as a harsh braking event and wherein the parameter is a severity of the harsh braking event.

3. The vehicle monitoring system of claim 2 wherein the processor is programmed to evaluate a plurality of severities of a plurality of harsh braking events and store the plurality of severities in association with each of the plurality of harsh braking events.

4. The vehicle monitoring system of claim 2 wherein the processor is programmed to assign a level of confidence to the classification of the event based upon the data.

5. The vehicle monitoring system of claim 1 wherein the at least one sensor includes an accelerometer and a vehicle speed sensor.

6. A vehicle monitoring system comprising:

at least one sensor in the vehicle, the at least one sensor recording performance of the vehicle, wherein the at least one sensor includes an accelerometer and a vehicle speed sensor; and a processor receiving data from the at least one sensor, the processor classifying the data from the at least one sensor as an event in one of a plurality of classifications, the processor associating at least one parameter with the event within the one of the plurality of classifications, wherein the processor is programmed to compare data from the accelerometer and the vehicle speed sensor to determine a type of road on which the vehicle is travelling.

7. The vehicle monitoring system of claim 5 wherein the processor is programmed to compare data from the accelerometer and the vehicle speed sensor to determine that the vehicle is travelling on an on-ramp or an off-ramp.

8. A vehicle monitoring system comprising:

at least one sensor in the vehicle, the at least one sensor recording performance of the vehicle, wherein the at least one sensor is a three-axis accelerometer; and a processor receiving data from the at least one sensor, the processor classifying the data from the at least one sensor as an event in one of a plurality of classifications, the processor associating at least one parameter with the event within the one of the plurality of classifications, wherein the processor is programmed to evaluate the data from the three-axis accelerometer to determine unbalanced wheels of the vehicle.

9. The vehicle monitoring system of claim 1 wherein the processor is on-board the vehicle.

10. The vehicle monitoring system of claim 9 wherein the processor is programmed to optimize compression of the data based upon historical data and to transmit the compressed data to a remote server.

11. The vehicle monitoring system of claim 1 wherein the processor is located remotely from the vehicle.

12. The vehicle monitoring system of claim 6 wherein the processor is programmed to determine the type of road on which the vehicle is travelling, wherein the types of road are selected from the group: dirt road and pavement.

* * * * *